US005555646A

United States Patent [19]

Kilpeläinen et al.

[11] Patent Number: 5,555,646

[45] Date of Patent: Sep. 17, 1996

[54] APPARATUS FOR STEAMING A MATERIAL IN A SILO

[75] Inventors: Reijo Kilpeläinen, Kitee; Risto Laukkanen; Matti Virolainen, both of Savonlinna, all of Finland

[73] Assignee: Andritz-Patentverwaltungs-Gesellschaft m.b.H., Graz, Austria

[21] Appl. No.: 193,395

[22] Filed: Feb. 7, 1994

[30] Foreign Application Priority Data

Nov. 2, 1993 [FI] Finland ..... 930596

[51] Int. Cl.[6] ..... F26B 17/00

[52] U.S. Cl. ..... 34/585; 34/389; 34/582

[58] Field of Search ..... 34/389, 582, 585

[56] References Cited

U.S. PATENT DOCUMENTS 2,745,743 5/1956 Knopf .

4,124,440 11/1978 Sherman ..... 162/246

4,721,231 1/1988 Richter ..... 222/146.4

4,867,845 9/1989 Elmore ..... 162/243

FOREIGN PATENT DOCUMENTS 1146788 5/1983 Canada .

*Primary Examiner*—Henry A. Bennett

*Assistant Examiner*—Dinnatia Doster

*Attorney, Agent, or Firm*—Birch, Stewart, Kolasch & Birch, LLP

[57] ABSTRACT

An apparatus for supplying steam into a silo (1) having a bottom (3), a wall and a discharger with a discharger arm (6) placed in the lower part of the silo. The discharger is mounted in the bottom of the silo by a bearing. The silo is provided with a steam supplying element, such as a steam feed pipe (14), extending from the central part of the bottom (3) into the interior of the silo. The feed pipe (14) is preferably passed through the bearing of the discharger and the end of the pipe (14) is provided with a cap (16) protecting the nozzles (15).

20 Claims, 2 Drawing Sheets

APPARATUS FOR STEAMING A MATERIAL IN A SILO

FIELD OF THE INVENTION

The present invention relates to an apparatus for steaming a material in a silo.

DESCRIPTION OF THE BACKGROUND ART

In the pulp industry, the wood used as raw material is cut into chips as required for the production process. Besides external dimensions, the chips must be of the right quality with respect to other properties as well. The chips are conveyed into a steaming silo and from there further to the pulping process. In the silo, the moisture of the chips is adjusted to a suitable level by supplying steam into the silo. At the same time, the air among the chips, which is detrimental to the pulping process, is removed.

In previously known technology, the steam is passed into the silo via steam pipes with nozzles placed at different heights on the silo walls or on the bottom of the silo. In these solutions, the steam is unevenly distributed in different parts of the silo, because the area close to the nozzle receives the most steam while the areas farthest away, especially in the horizontal direction, receives the least steam. To achieve uniform moisture, the pressure or amount of steam or the number of steam pipes and nozzles has to be increased. Both solutions are expensive to implement and they also increase the number of parts requiring service.

SUMMARY OF THE INVENTION

The object of the invention is to achieve a steam supplying apparatus allowing the steam to be evenly distributed in the whole mass of chips in a chip silo. To implement this, the invention includes an apparatus for supplying steam into a silo, the silo having a bottom, at least one wall and a discharger. The discharger has a discharger arm and is mounted in a lower part of the silo by a bearing. The apparatus comprises a steam supply tubing connected to a steam source. The steam supply tubing has at least one steam feed pipe extending substantially from a central part of the bottom of the silo into an interior of the silo. The at least one steam feed pipe has a steam outlet which is movable within the silo to direct steam to different parts of the silo.

With the apparatus of the invention, the steam can be uniformly distributed in different parts of the silo, so that the whole mass of chips is steamed. In this solution, no ducts for steam pipes are required in the walls of the silo because the pipes are passed through the bearing of a discharger mounted at the bottom. Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE PREFERRED EMBODIMENTS

In the following, the invention is described by the aid of one of its embodiments by referring to the drawings which are given by way of illustration only, and thus are not limitative of the present invention, and in which:

FIG. 1 presents the bottom of a silo in top view;

FIG. 2 presents the silo bottom of FIG. 1 as sectioned along line A—A; and FIG. 3 presents the silo bottom of FIG. 1 as sectioned along line B—B.

DETAILED DESCRIPTION OF THE PREFERRED EMBODIMENTS

Figure 1:
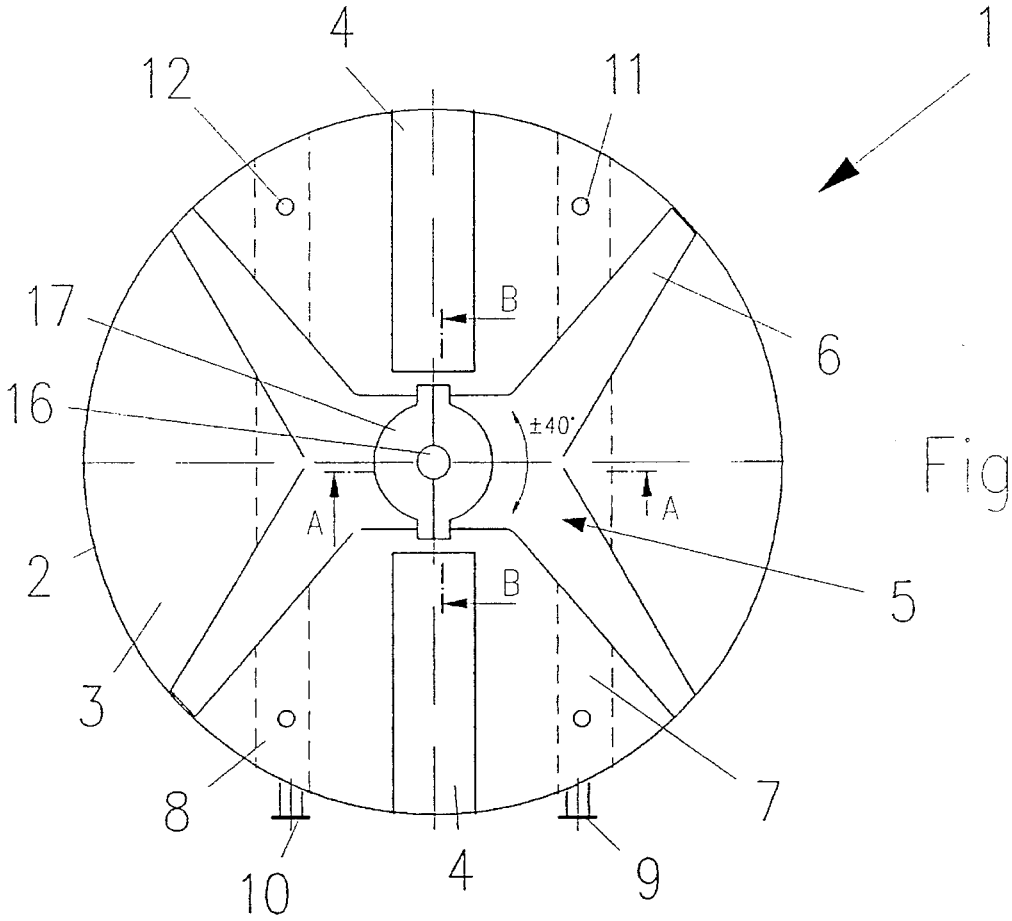
Figure 2:
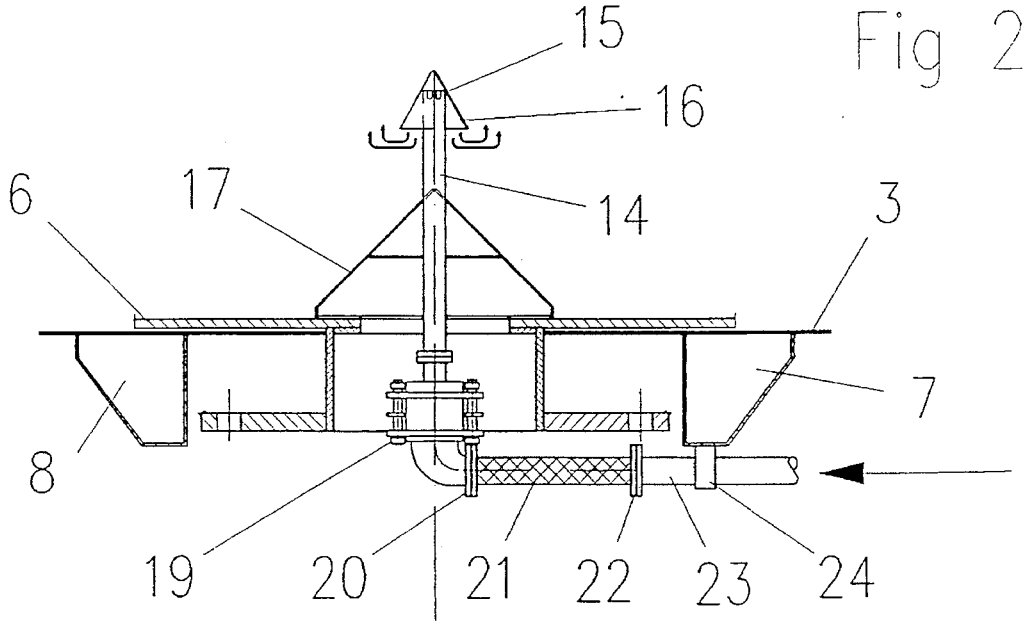

FIG. 1 illustrates the structure of the bottom of the silo 1 as seen from above. The silo consists of a cylindrical wall 2 attached at its lower edge to a bottom plate 3 and at the upper edge to a top structure (not shown). The chips are supplied into the silo through the top part and removed from it through discharge openings 4 formed in the bottom 3. Mounted in the middle of the bottom plate is a discharger consisting of a discharger hub 5 supported by a bearing in the bottom plate and discharger arms 6 attached to the hub 5. The discharger is turned back and forth through an angle of about ±40° by means of an actuator (not shown). The four arms sweep the whole bottom of the silo, moving the chips towards the discharge openings 4. Placed below the silo bottom are two channels 7 and 8, the ends 9 and 10 of which are provided with junctions for the connection of steam supply pipes. The silo bottom 3 is provided with steam supply holes 11 and 12 placed along the channels 7 and 8. According to the invention, in addition to the previously known structure described above, steam is supplied via steam feed pipes placed under protective hoods 16 and 17 in the hub as described in greater detail in connection with FIG. 2 and 3. FIG. 2 presents section A—A in FIG. 1 near the bottom of the silo. The hub 5 of the discharger is mounted with a bearing 13 in the middle of the silo bottom 3. According to the invention, a steam feed pipe 14 goes through the hub 5 into the silo. As shown in FIG. 2, the steam feed pipe 14 extends above the silo bottom and terminates with a nozzle 15 mounted on its end. Mounted on top of the nozzle 15 is a cap 16 acting as a protective hood preventing the nozzle 15 from being blocked by chips. Placed below the nozzle 15 and cap 16 is another cap 17 of a triangular cross-section, covering auxiliary pipes (FIG. 3) branching off from the supply pipe as well as the hub of the discharger, protecting it from the chips. The lower end of the supply pipe is connected to a rotating steam feed connector 19 consisting of a commercial product. The steam feed connector 19 permits up-and-down motion of the feed pipe 14 attached to the discharger. The other end of the connector 19 is attached with a flange 20 to a flexible hose 21 which allows thermal expansion and other deformations requiring flexibility during the process. The hose is further connected with a flange 22 to a steam supply pipe 23 conveying steam from a steam source (not shown). The supply pipe 23 is attached with a fixing element to a steam channel 7 below the silo bottom. The steam supply pipe 23, the hose 21 and the feed pipe 14 with its lateral branches, together with the connector elements placed between them as described above, constitute the steam feed tubing in this embodiment of the invention.

Figure 3:
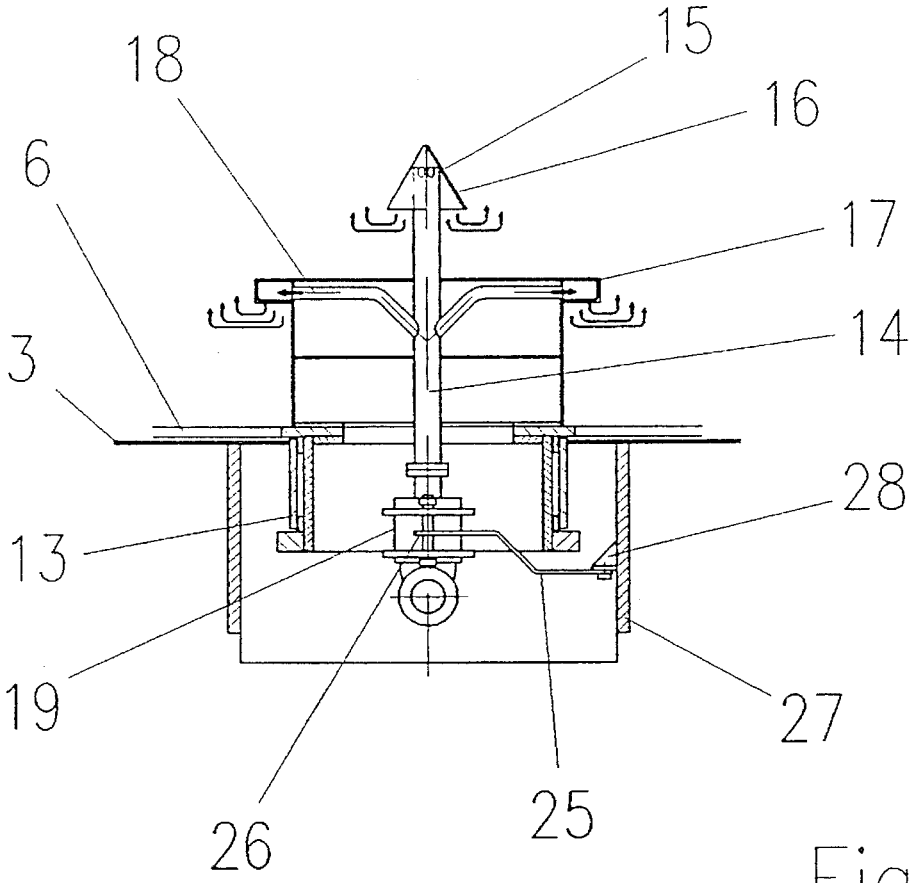

FIG. 3 presents section B—B in FIG. 1 and uses the same reference numbers as FIG. 2 for corresponding parts. The steam feed pipe 14 is provided with lateral branches 18 conveying steam to the edges of the cap 17 placed above the hub and serving as a protective hood. The ends of the lateral branches can be provided with nozzles, or they may be simply placed with their open ends under the cap edge as shown. As the discharger is rotated back and forth, the steam feed points move correspondingly back and forth in relation to the bottom of the silo. The direction of steam flow from the pipes 14 and 18 and from under the caps 16 and 17 out into the silo space is indicated by arrows in FIG. 2 and 3. The body 26 of the rotating steam feed connector 19 is fixed with a connecting piece 25 to a fixing lug 28 provided in the silo frame structure 28, whereby the connector 19 is held in place despite the torsional force applied to the pipe.

Although in the above description the steam is supplied via pipes, the steam supply can just as well be implemented by providing the caps with channels or plates to direct the steam flow. The protective caps 16 and 17 can also be shaped so as to form steam guides. In any case, the essential point is that the steam is conveyed into the chip mass inside the silo and that the outlet openings or nozzles of the steam feed pipes are moved so as to direct the steam to different parts of the silo.

To pass the steam further to parts farther away from the center of the silo, the steam feed pipe 14 can be provided with additional branches extending towards the edges of the silo and attached to the discharger arms 6. If the bottom plate is provided with steam feed openings, the additional branches preferably extend to a distance allowing their outlet openings to be located in the areas between the steam feed openings 11 and 12 in the silo bottom. In this way, a balanced coverage of the whole silo area will be achieved. The additional branches can be attached to the discharger arms or integrated in the arm structures. The outlet openings of the additional branches are preferably located under the edge of the discharger arm to avoid pipe blockages.

The invention has been described above by the aid of one of its embodiments. However, the presentation is not to be regarded as limiting the invention, but the embodiments of the invention may vary within the limits defined by the claims.

We claim:

1. An apparatus for supplying steam into a silo, the silo having a bottom, at least one wall and a discharger, the discharger having a discharger arm, the discharger being mounted in a lower part of the silo by a bearing, the apparatus comprising a steam supply tubing connected to a steam source, the steam supply tubing having at least one steam feed pipe extending substantially from a central part of the bottom of the silo into an interior of the silo, the at least one steam feed pipe having a steam outlet which is movable within the silo to direct steam to different parts of the silo.

2. The apparatus for supplying steam into a silo according to claim 1, wherein the steam supply tubing enters the silo through the bearing of the discharger.

3. The apparatus for supplying steam into a silo according to claim 2, further comprising a rotating connector for connecting the steam source and the steam supply pipe.

4. The apparatus for supplying steam into a silo according to claim 1, wherein the steam feed pipe is provided with lateral branches extending into the discharger arms, the lateral branches being connected to the steam supply.

5. The apparatus for supplying steam into a silo according to claim 4, wherein the lateral branches and the feed pipe are provided with nozzles.

6. The apparatus for supplying steam into a silo according to claim 5, further comprising a protective hood provided above at least one of the nozzles.

7. The apparatus for supplying steam into a silo according to claim 1, wherein the steam feed pipe is provided with additional branches extending into the discharger arms, the additional branches being connected to the steam supply.

8. The apparatus for supplying steam into a silo according to claim 7, wherein the additional branches and the feed pipe are provided with nozzles.

9. The apparatus for supplying steam into a silo according to claim 8, further comprising a protective hood provided above at least one of the nozzles.

10. The apparatus for supplying steam into a silo according to claim 1, wherein the feed pipe is provided with a nozzle.

11. The apparatus for supplying steam into a silo according to claim 10, further comprising a protective hood provided above the nozzle.

12. The apparatus for supplying steam into a silo according to claim 1, further comprising means for moving the discharger and for moving the outlet of the steam feed pipe.

13. The apparatus for supplying steam into a silo according to claim 12, wherein the steam outlet and the discharger are simultaneously moved by the means for moving.

14. The apparatus for supplying steam into a silo according to claim 12, wherein the means for moving rotates the discharger and the steam outlet about a vertical axis through an angle of 40°.

15. A method for supplying steam into a silo, the silo having a bottom, at least one wall and a discharger, the discharger having a discharger arm, the discharger being mounted in a lower part of the silo by a bearing, the method comprising the steps of:

providing a steam supply tubing connected to a steam source, the steam supply tubing having at least one steam feed pipe extending substantially from a central part of the bottom of the silo into an interior of the silo;

supplying steam from the steam source to the steam feed pipe;

discharging steam from the steam feed pipe into the silo through a steam outlet in the steam feed pipe; and moving the outlet of the steam feed pipe within the silo to thereby direct steam to different parts of the silo.

16. The method according to claim 15, wherein the step of moving comprises the step of rotating the outlet of the steam feed pipe about a vertical axis.

17. The method according to claim 16, wherein the step of rotating comprises rotating the steam outlet through an angle of 40°.

18. The method according to claim 15, further comprising the steps of:

providing other branches, the other branches being at least one of lateral branches and additional branches connected to the steam supply;

supplying steam to the at least one of lateral other branches; and discharging steam from steam outlets of in the other branches to the silo.

19. The method according to claim 18, further comprising the step of moving the steam outlets in the other branches with the outlet in the steam feed pipe.

20. The method according to claim 15, further comprising the step of moving the discharger with the steam feed pipe.

* * * * *

UNITED STATES PATENT AND TRADEMARK OFFICE

CERTIFICATE OF CORRECTION

PATENT NO. : 5,555,646

DATED : September 17, 1996

INVENTOR(S) : Kilpeläinen et al.

It is certified that error appears in the above-indentified patent and that said Letters Patent is hereby corrected as shown below:

On the cover page:

item [30] Foreign Application Priority Data

Change "Nov. 2, 1993" to --Feb. 11, 1993--

Signed and Sealed this

Eighth Day of April, 1997

Bruce Lehman

*Attest:*

BRUCE LEHMAN

*Attesting Officer*

*Commissioner of Patents and Trademarks*